US010427413B2

(12) United States Patent
Saito et al.

(10) Patent No.: US 10,427,413 B2
(45) Date of Patent: Oct. 1, 2019

(54) LIQUID EJECTION HEAD

(71) Applicant: CANON KABUSHIKI KAISHA, Tokyo (JP)

(72) Inventors: Akiko Saito, Tokyo (JP); Shintaro Kasai, Yokohama (JP); Yoshiyuki Nakagawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 73 days.

(21) Appl. No.: 15/598,138

(22) Filed: May 17, 2017

(65) Prior Publication Data

US 2017/0334210 A1 Nov. 23, 2017

(30) Foreign Application Priority Data

May 20, 2016 (JP) ..... 2016-101743
Mar. 9, 2017 (JP) ..... 2017-044844

(51) Int. Cl.
*B41J 2/17* (2006.01)
*B41J 2/175* (2006.01)
*B41J 2/14* (2006.01)

(52) U.S. Cl.
CPC ..... *B41J 2/17523* (2013.01); *B41J 2/1404* (2013.01); *B41J 2002/14403* (2013.01); *B41J 2002/14467* (2013.01)

(58) Field of Classification Search
None
See application file for complete search history.

(56) References Cited

U.S. PATENT DOCUMENTS 6,305,792 B1 * 10/2001 Otsuka ..... B41J 2/1404 347/71
8,308,275 B2 11/2012 Xie
2001/0030673 A1 * 10/2001 Shigemura ..... B41J 2/14209 347/68

* cited by examiner

*Primary Examiner* — Erica S Lin
(74) *Attorney, Agent, or Firm* — Canon U.S.A., Inc. I.P. Division

(57) ABSTRACT

A liquid ejection head includes a plurality of liquid chambers each including an energy generating element that generates energy for ejecting a liquid, an ejection opening that ejects the liquid, and a liquid supply opening that supplies the liquid, the liquid flowing in a first direction in the plurality of liquid chambers, and the plurality of liquid chambers being arranged in a second direction that intersects the first direction, and a plurality of first side walls that extend in the first direction and that form walls on both sides of the plurality of liquid chambers. In the liquid ejection head, each of the plurality of first side walls includes a fragmenting portion that fragments each of the plurality of first side walls in the first direction.

8 Claims, 8 Drawing Sheets

LIQUID EJECTION HEAD

BACKGROUND OF THE INVENTION

Field of the Invention

The present disclosure relates to a liquid ejection head and, particularly, relates to a configuration of side walls that partition liquid chambers.

Description of the Related Art

There are cases in which a member (hereinafter, referred to as an ejection opening forming member), which forms ejection openings of a liquid ejection head, becomes swelled by being in contact with a liquid for a long period of time and by heat. Swelling of the ejection opening forming member causes the ejection openings to become deformed. Specifically, in the ejection opening forming member, upon swelling of side walls that partition adjacent energy generating elements, distances from a substrate in which the energy generating elements are formed to the ejection openings increase, and diameters of the ejection openings decrease. Due to the above, there are cases in which variation in the ejection volume of the liquid ejected from the ejection openings and misplacement of the landing position occur causing degradation in image quality. Description of U.S. Pat. No. 8,308,275 discloses a liquid ejection head in which fragmenting portions are provided in side walls. According to such a configuration, the deformation of the side walls is absorbed by the fragmenting portions such that the deformation of the ejection openings is decreased.

In the liquid ejection head described in the Description of U.S. Pat. No. 8,308,275, between two side walls defining the liquid chambers, among the liquid chambers that are arranged in a row, at the end portions, the fragmenting portions are provided in the side wall on the inside; however, the side wall on the outside is not provided with a fragmenting portion. Since the side wall on the outside that is not provided with a fragmenting portion extends in a continuous manner, the deformation of the side wall on the outside due to swelling is strongly constrained; however, in the case of the side wall on the inside that is provided with the fragmenting portions, the deformation due to swelling is absorbed by the fragmenting portions. Accordingly, the two side walls deform in a different deformation mode and, as a result, the ejection opening may be easily inclined and the landing position of the droplet may be misplaced. On the other hand, since the fragmenting portions are provided in the sets of two side walls defining the liquid chambers on the inside arranged in a row, the sets of two side walls deform in a substantially same deformation mode, such that, inclination of the ejection openings does not easily occur. In other words, in the liquid ejection head described in the Description of U.S. Pat. No. 8,308,275, the manner in which the ejection openings deform tends to vary depending on the position of the ejection openings.

SUMMARY OF THE INVENTION

The present disclosure provides a liquid ejection head that is capable of suppressing variation in the deformation of the plurality of ejection openings due to swelling.

According to an aspect of the present disclosure, a liquid ejection head includes a plurality of liquid chambers each including an energy generating element that generates energy for ejecting a liquid, an ejection opening that ejects the liquid, and a liquid supply opening that supplies the liquid, the liquid flowing in a first direction in the plurality of liquid chambers, and the plurality of liquid chambers being arranged in a second direction that intersects the first direction; and a plurality of first side walls that extend in the first direction and that form walls on both sides of the plurality of liquid chambers. In the liquid ejection head, each of the plurality of first side walls includes a fragmenting portion that fragments each of the plurality of first side walls in the first direction, or a section reducing portion that is a portion in which a section vertical to the first direction has been scaled down.

Further features of the present disclosure will become apparent from the following description of exemplary embodiments with reference to the attached drawings.

DESCRIPTION OF THE EMBODIMENTS

Hereinafter, some embodiments of the present disclosure will be described with reference to the drawings. While the liquid ejection heads of the exemplary embodiments described below adopt a thermal method that elects ink by creating a bubble with a heating element, the present disclosure can be used in liquid ejection heads adopting a piezoelectric method and other various liquid election methods. While the liquid ejection heads of the exemplary embodiments eject ink, the present disclosure can be used in liquid election heads that eject a liquid other than ink. In the exemplary embodiments below, a first direction X is a direction in which ink inside liquid chambers flows, or a direction in which first side walls extend, and a second direction Y is a direction in which the plurality of liquid chambers are arranged. In each of the exemplary embodiments, while the second direction Y is orthogonal to the first direction X, the second direction Y does not have to be orthogonal to the first direction X as long as the second direction Y intersects the first direction X.

First Exemplary Embodiment

Figure 1A:
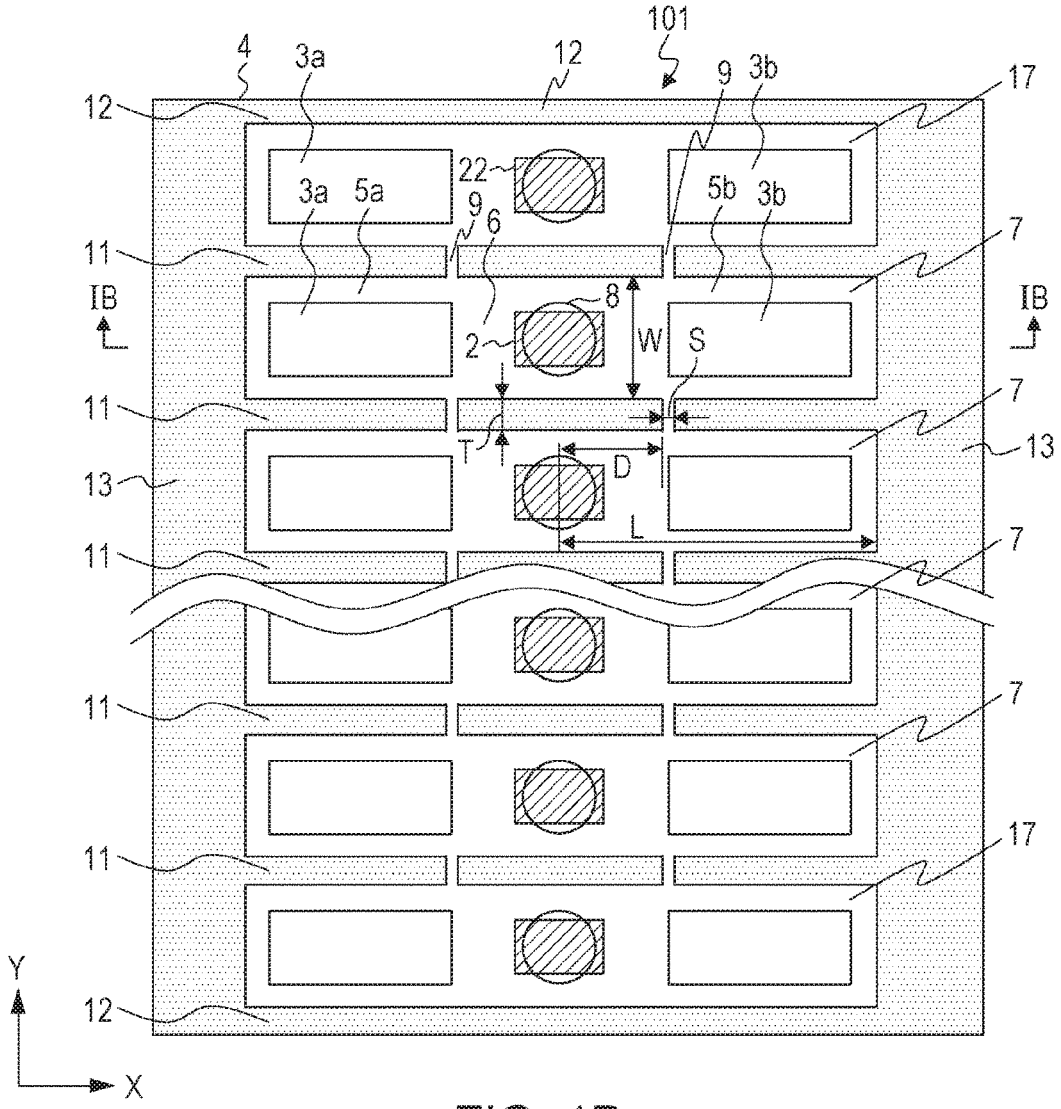
FIG. 1A is a schematic plan view and FIG. 1B is a cross-sectional view of a liquid ejection head of a first exemplary embodiment of the present disclosure.
Figure 1B:
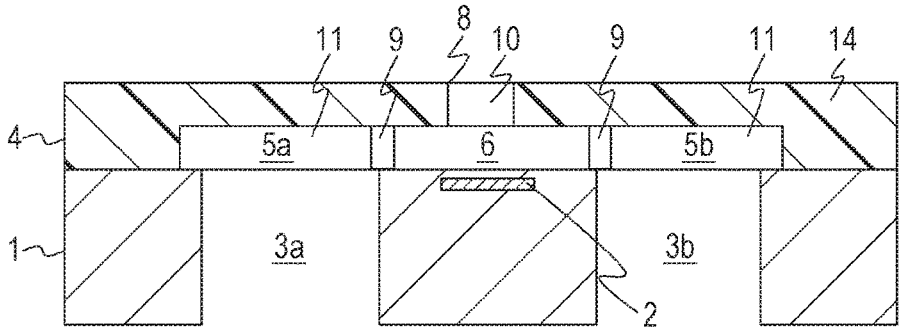

FIG. 1A is a plan view illustrating a liquid ejection head of a first exemplary embodiment of the present disclosure in a partial and schematic manner, and FIG. 1B is a cross-sectional view taken along line IB-IB in FIG. 1A. The first direction X corresponds to a width direction of a recording medium, and the second direction Y corresponds to a transport direction of the recording medium.

A liquid ejection head 101 includes a substrate 1 and an ejection opening forming member 4 formed on the substrate 1. The substrate 1 is formed of silicon, and the ejection opening forming member 4 is formed of resin. In the present exemplary embodiment, an ejection opening forming member that is formed of resin and that is easily affected by heat and swell in is described; however, the present disclosure is not limited to such an ejection opening forming member. The present disclosure can be applied to an ejection opening forming member formed of an inorganic material, such as silicone, or a metal material, such as stainless steel. A plurality of energy generating elements 2 that generate energy for ejecting a liquid are formed in the substrate 1. Each energy generating element 2 includes a heat generating element that generates heat upon application of a current. A plurality of liquid supply openings 3*a* that supply ink, and a plurality of liquid collect openings 3*b* that collect ink are formed in the substrate 1. The liquid collect openings 3*b* are provided on the opposite side of the liquid supply openings 3*a* with respect to the energy generating elements 2. The liquid supply openings 3*a* and the liquid collect openings 3*b* are through holes that penetrate through the substrate 1 in the thickness direction and are connected to a common liquid flow path (not shown). The energy generating elements 2, the liquid supply openings 3*a*, and the liquid collect openings 3*b* are each arranged in the second direction Y.

The ejection opening forming member 4 includes a plurality of first side walls 11 that extend in the first direction X, two third side walls 13 that are adhered to the first side walls 11 and that extend in the second direction Y, and a top plate 14 that is adhered to the first and third side walls 11 and 13. The plurality of first side walls 11 are arranged in the second direction Y. A plurality of ejection openings 8 that oppose the energy generating elements 2 and that eject ink are formed in the top plate 14. A plurality of liquid chambers 7 that each include the energy generating element 2, the liquid supply opening 3*a*, and the liquid collect opening 3*b* are formed between the ejection opening forming member 4 and the substrate 1 with the first side walls 11, the third side walls 13, and the top plate 14. The plurality of liquid chambers 7 are arranged in the second direction Y. Each liquid chamber 7 is defined by two first side walls 11 that are adjacent to each other, and two third side walls 13. In other words, walls extending in the first direction X on both sides of each liquid chamber 7 are formed by two first side walls 11 with the liquid chamber 7 in between, and walls extending in the second direction Y on both sides of each liquid chamber 7 are formed by two third side walls 13 with the liquid chamber 7 in between. The liquid chambers 7 are each formed of a pressure chamber 6 in which the energy generating element 2 is formed, a liquid supply passage 5*a* in which the liquid supply opening 3*a* opens, and a liquid collect passage 5*b* in which the liquid collect opening 3*b* opens. The plurality of liquid chambers 7 are formed in a symmetrical manner with respect to a line that passes through the centers of the energy generating elements 2, or the ejection openings 8, and that extends in the second direction Y, and the liquid supply openings 3*a* and the liquid collect openings 3*b* are, with respect each other, formed symmetrical to the line. Each pressure chamber 6 is an area that is interposed between two of the corresponding first side walls 11 and where the corresponding energy generating element 2 is provided, and in a broad sense, is an area to where a pressure is applied when the corresponding energy generating element 2 is driven.

Ink in each plurality of liquid chamber 7 flows in the first direction X. In other words, ink flows into the liquid supply passage 5*a* from the liquid supply opening 3*a*, passes through the pressure chamber 6 and the liquid collect passage 5*b*, and flows out from the liquid collect opening 3*b*. Accordingly, ink in which moisture has evaporated and that has become thickened does not easily become stagnated in the vicinity of the election opening 8 and, accordingly, leads to an improvement in image quality. Second liquid supply openings may be provided in place of the liquid collect openings 3*b*. In such a case, since ink is supplied to the pressure chamber 6 from two directions, the ink supplying ability improves such that high-speed printing is facilitated.

While each first side wall 11 is shared by adjacent liquid chambers 7, each liquid chamber 7 may be provided with separate first side walls 11. In such a case, the liquid chamber 7 and a space in which no ink flows are arranged alternately.

The top plate 14 is a flat plate that extends substantially parallel to the substrate 1 and is adhered to or integral to the plurality of first side wall 11 and the two third side walls 13. A plurality of through holes 10 penetrate the top plate 14, and ejection openings 8 are formed at the ends of the through holes 10 on the side opposite to the plurality of liquid chambers 7, in other words, at the ends of the through holes 10 that oppose the recording medium. The ejection openings 8 oppose the energy generating elements 2 in a direction perpendicular to the surface of the substrate 1 that opposes the ejection opening forming member 4. By driving the energy generating elements 2, bubbles are formed inside the ink and with the pressure created during the formation of the bubbles, the ink is pushed out from, the through holes 10 and is ejected from the ejection openings 8.

The ejection opening forming member 4 includes two second side walls 12 that are positioned at the end portions thereof in the second direction Y and that are connected to the first side walls 11. The second side walls 12 are also connected to the third side walls 13. The second side walls 12 and the first side walls 11 at the end portions form dummy liquid chambers 17. The liquid supply openings 3*a* and the liquid collect openings 3*b* are also formed in the dummy liquid chambers 17 through which ink flows in and out. Since the second side walls 12 extends in a continuous manner and is not provided with any fragmenting portions 9 described later, leaking of ink from the dummy liquid chambers 17 to the outside of the liquid ejection head 101 is prevented. The dummy liquid chambers 17 are provided with dummy elements 22 that are not driven; accordingly, the dummy liquid chambers 17 do not contribute to the ejection of ink. Alternatively, the energy generating elements 2 or the dummy elements 22 do not have to be provided in the dummy liquid chambers 17.

Figure 2A:
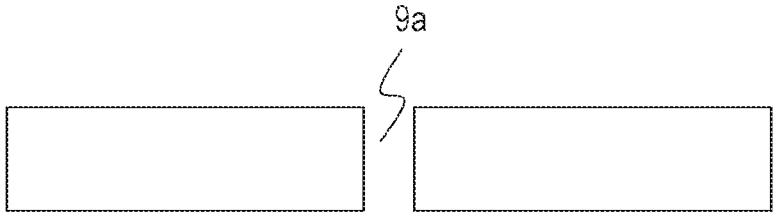
FIGS. 2A to 2D are conceptual diagrams illustrating various shapes of fragmenting portions.
Figure 2B:
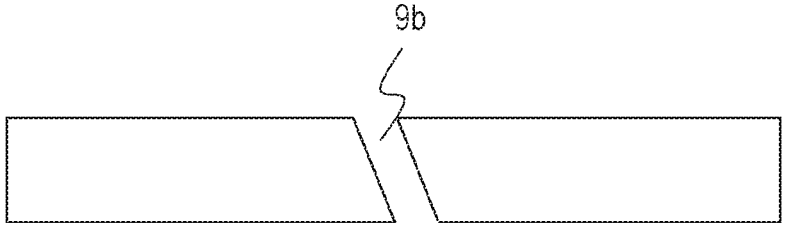
Figure 2C:
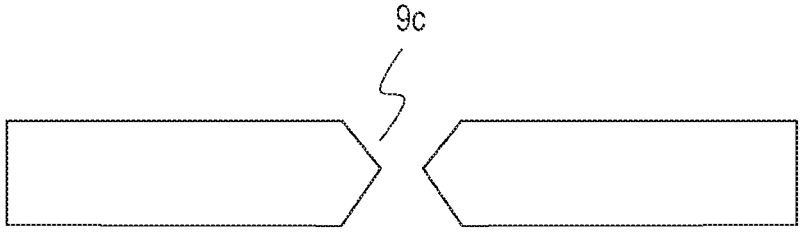
Figure 2D:
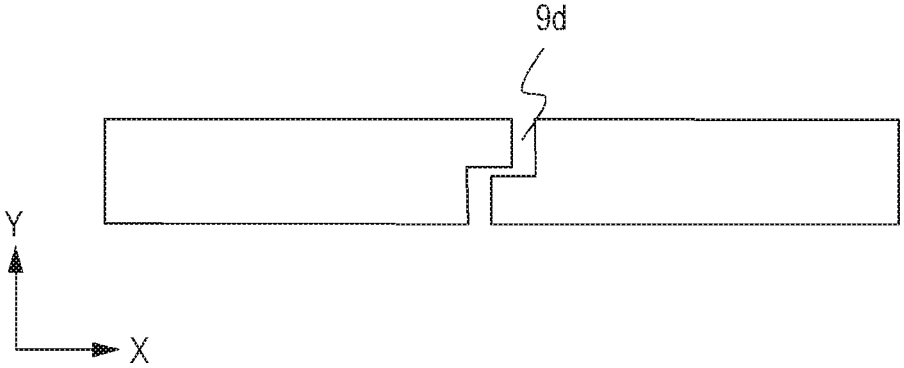

Each of the first side walls 11 includes two fragmenting portions 9 that fragment the first side wall 11 in the first direction X. A fragmenting portion 9 is provided on each side of the ejection opening 8 in the first direction X at equidistant positions with respect to the ejection opening 8. Although each fragmenting portion 9 has a slit-like shape, the shape is not limited to any shape in particular. Each fragmenting portion 9 may be, for example, a linear slit 9*a* illustrated in FIG. 2A that extends in the second direction Y, or may be a linear slit 9*b* illustrated in FIG. 2B that extends in a direction that is oblique with respect to the second direction Y. The fragmenting portion 9 may be a slit 9*c* illustrated in FIG. 20 in which the width in the first direction X changes in the second direction Y, or may be a slit 9*d* formed so as to have a polygonal line-like shape illustrated in FIG. 3D.

Figure 3A:
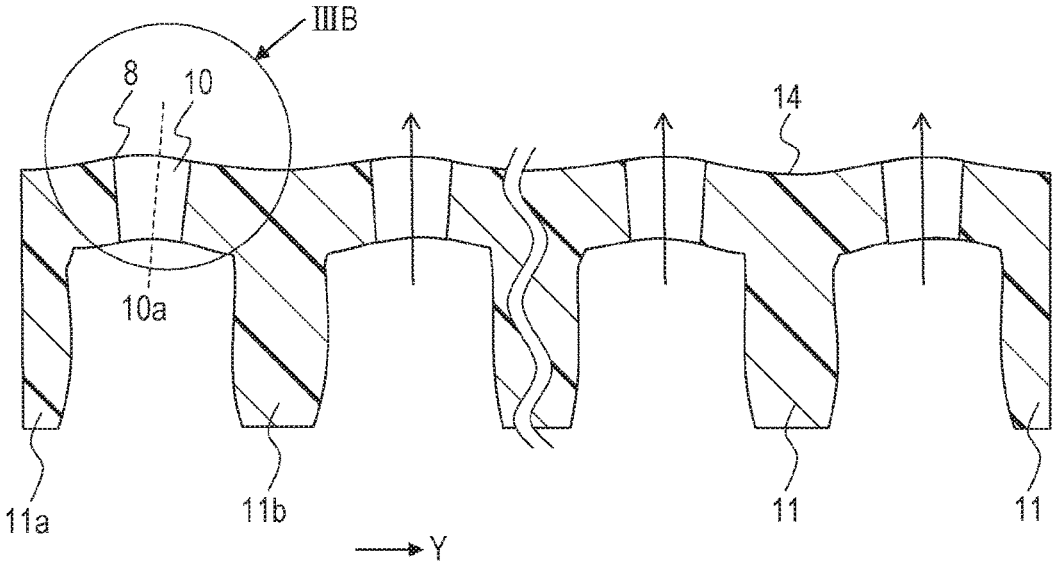
FIGS. 3A and 3B are cross-sectional views illustrating liquid ejection heads of comparative examples in a schematic manner.
Figure 3B:
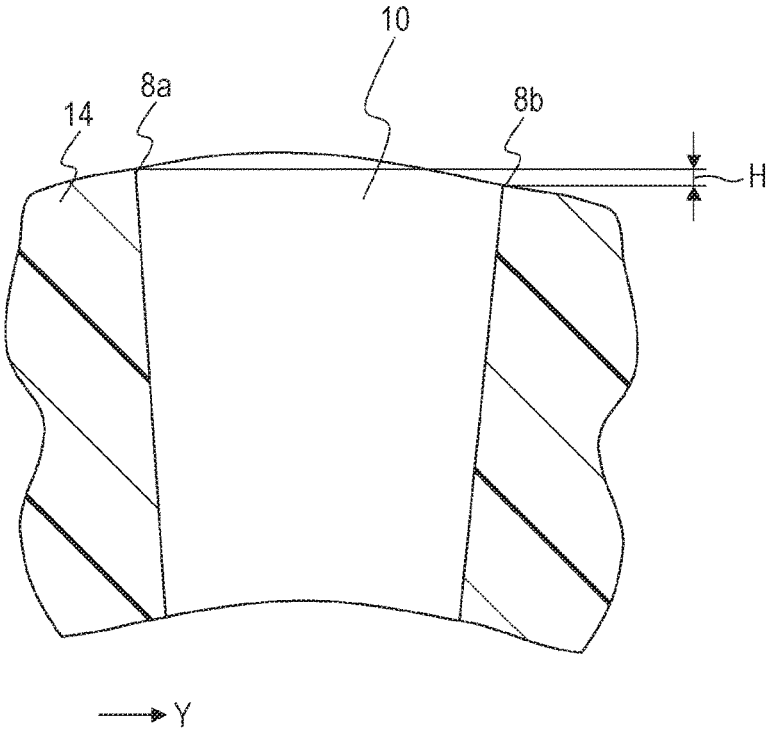

In a liquid ejection head, the configuration of first side walls 11*a* at the end portions and the configuration of second side walls 11*a* that are the next side walls inside the first side walls 11*a* are different, and when ink is filled inside the liquid chamber 7 and when the ejection opening forming member 4 becomes deformed due to swelling, as illustrated in FIGS. 3A and 3B, the ejection openings 8 at the end portions are obliquely deformed with respect to the substrate 1. Note that FIG. 3A is a cross-sectional view of a conventional liquid ejection head, and FIG. 3B is an enlarged view of IIIB in FIG. 3A. Specifically, the deformation of the first side walls 11*a* at the end portions are strongly constrained in the first direction X and the first side walls 11*b* that are the next side walls on the inner side are, compared with the first side wall 11*a* at the end portions, not easily constrained since fragmenting portions 9 are provided. Accordingly, the ejection openings 8 at the end portions deform so as to become inclined towards the first side walls 11*b* that are the next side walls on the inner side. In other words, the ejection openings 8 deform in such a way that the end portions 8*b* of the election openings on the inner side in the second direction Y sink with respect to the end portions 8*a* on the outer side, such that a height difference H is created. Meanwhile, since the two side walls 11 of each ejection opening 8 on the inner side are both provided with the fragmenting portions 9, although the side walls 11 bulge in a direction away from the substrate 1, each ejection opening 8 does not become greatly inclined in the second direction Y. As a result, only the ejection openings 8 at the end portions are deformed in a greatly inclined manner, such that central axes 10*a* of through holes 10 become inclined with respect to the substrate 1 and the landing positions of the ink droplets become misplaced.

In the present exemplary embodiment, as described above, the dummy liquid chambers 17 are provided outside the liquid chambers 7 at the end portions. Accordingly, the fragmenting portions 9 can be provided in the first side walls 11 at the end portions in the second direction Y in a similar manner to the other first side walls 11. Since the two first side walls 11 of all the ejection openings 8 can be configured in the same manner, the above problem is resolved and the inclination of all of the ejection openings 8 can be reduced.

The fragmenting portions 9 are provided at the same positions in all of the first side walls 11. In other words, each fragmenting portion 9 provided in each first side wall 11 is provided on a straight line extending in the second direction Y in FIG. 1. Accordingly, in each of the ejection openings 8, the configuration of the ejection opening forming member 4 around each ejection opening 8 is symmetrical on the two sides of each ejection openings 8. As a result, all of the ejection openings 8 deform in a substantially same mode so as to be lifted in a parallel manner with respect to the substrate 1; accordingly, variation in the inclination of the ejection openings 8 can be suppressed. Accordingly, in the liquid ejection head 101 of the present exemplary embodiment, even in a state in which the ejection opening forming member 4 are swelled by ink, the plurality of central axes 10*a* of the through holes 10 extend in a substantially perpendicular manner with respect to the substrate 1.

In the exemplary embodiment illustrated in FIGS. 1A and 1B, each of the ejection openings 8, each of the liquid supply openings 3*a*, and each of the liquid collect openings 3*b* are arranged at intervals of 600 dpi in the second direction Y. A width W of each pressure chamber 6 is 30 μm, a width T of each first side wall 11 is 12 μm, a diameter of each ejection opening 8 is 20 μm, a length L from the center of each ejection opening 8 to the end portion of the corresponding liquid chamber 7 in the first direction X is 90 μm, and an opening width S of each fragmenting portion 9 is 5 μm. In a case in which the fragmenting portion 9 is positioned near the ejection opening 8, the crosstalk with the adjacent ejection opening 8 has a large effect. Accordingly, the fragmenting portion 9 is positioned near the liquid supply opening 3*a* with respect to the center of the ejection opening 8 in the first direction X. In order to further reduce the effect of the crosstalk, the opening width S of each fragmenting portion 9 is preferably 10 μm or smaller and, more preferably, is 5 μm or smaller. As described above, in the present exemplary embodiment, while the effect of the crosstalk is reduced, the deformation of the ejection openings 8 due to swelling can be suppressed; accordingly, printing of an image with high quality can be achieved.

Second Exemplary Embodiment

Figure 4A:
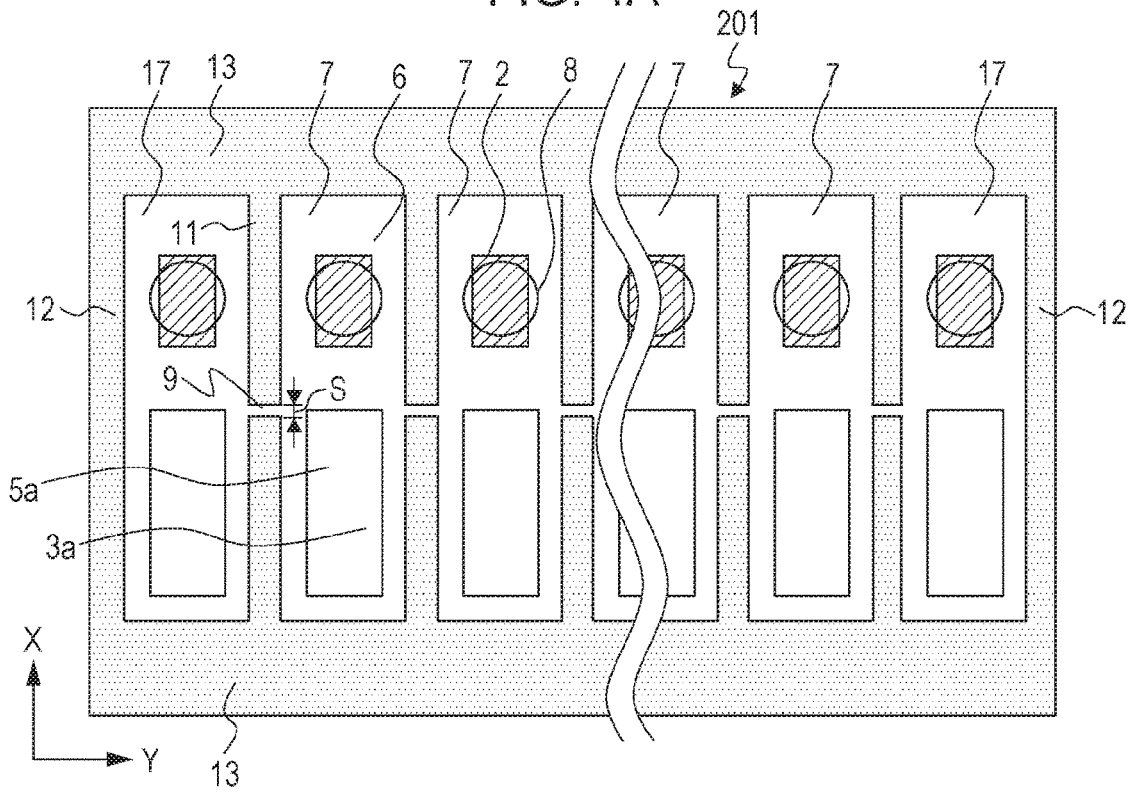
FIGS. 4A and 4B are schematic plan views of a liquid ejection head of a second exemplary embodiment of the present disclosure.

FIG. 4A is a plan view illustrating a liquid discharge head 201 of a second exemplary embodiment of the present disclosure in a partial and schematic manner. In the second exemplary embodiment, the ejection openings 8 are arranged in the width direction of the recording medium. In other words, the second direction Y corresponds to the width direction of the recording medium. In each liquid chamber 7, the side opposite to the liquid supply opening 3*a* with respect to the energy generating elements 2 is a dead end, and the liquid collect openings 3*b* is omitted. Only a single fragmenting portion 9 is provided in each first side wall 11 in a portion between the corresponding liquid supply opening 3*a* and the corresponding ejection opening 8. Each of the ejection openings 8 and each of the liquid supply openings 3*a* are arranged at intervals of 600 dpi in the second direction Y. The configurations and the effects that have not been described herein are similar to those of the first exemplary embodiment.

In the present exemplary embodiment as well, the deformation of the ejection openings 8, in particular, the inclination of the ejection openings 8 in the second direction Y, due to swelling of the ejection opening forming, member 4 can be suppressed with the fragmenting portions 9. The effect of suppressing the deformation of the ejection openings 8 becomes larger as the fragmenting portions 9 are disposed closer to the ejection openings 8, and becomes smaller as the fragmenting portions 9 are disposed farther away from the ejection openings 8. Similar to the first exemplary embodiment, by forming each fragmenting portion 9 so that the opening width S is 10 μm or smaller and, preferably, 5 μm, or smaller, while suppressing deformation of the ejection openings 8, the liquid ejection head 201 that can reduce the effect that the crosstalk has on the adjacent election opening 8 can be obtained. In the present exemplary embodiment, since the third side walls 13 are in the vicinity of the ejection openings 8, it is difficult to suppress the deformation of the ejection openings 8 in the first direction. X. However, while it is difficult to correct the ink landing positions in the second direction Y, the ink landing positions in the first direction X can be corrected easily by adjustment of the print conditions and the like.

Figure 4B:
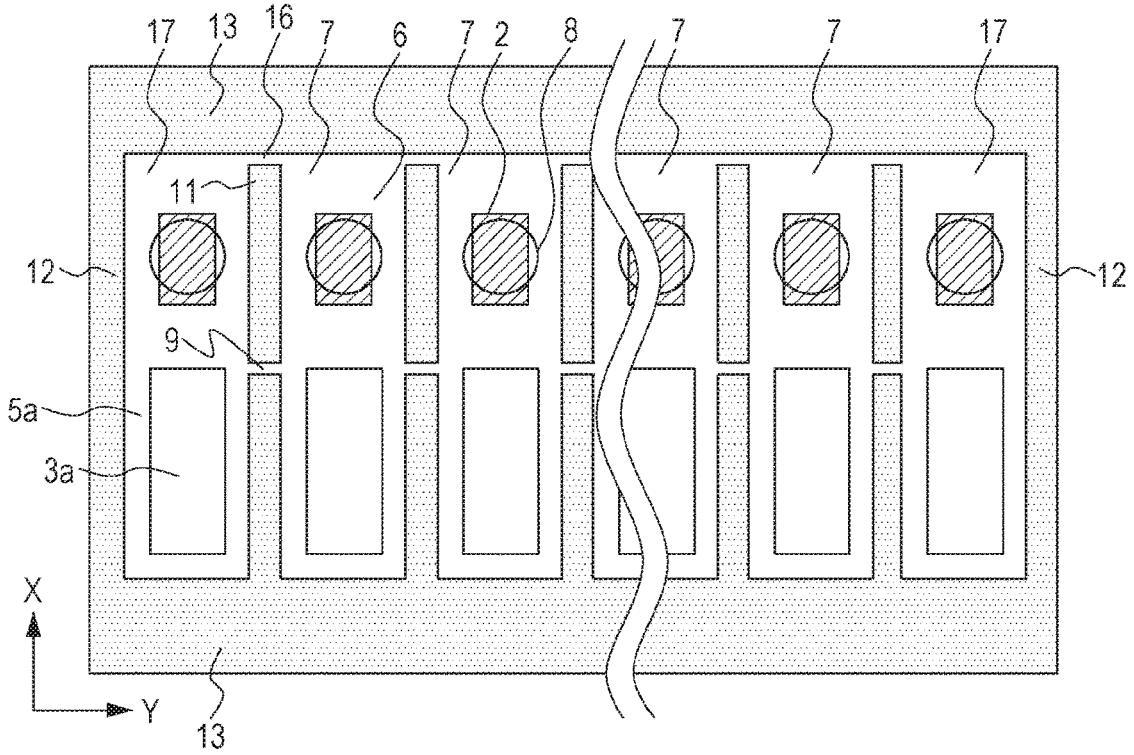

As illustrated in FIG. 4B, the first side walls 11 may be separated from the third side wall 13 that is in the vicinity of the energy generating elements 2. Fragmenting portions 16 and the fragmenting portions 9 of the first side wall 11 are provided on each side of the ejection openings 8 in the first direction X at equidistant positions with respect to the ejection openings 8. Depending on the lengths of the pressure chambers 6, two fragmenting portions 9 may be provided in each of the first side walls 11. Since the first side walls 11 are separated from the third side walls 13, an effect of suppressing the deformation of the ejection openings 8 in the first direction X can be obtained. Although the effect that the crosstalk has will increase with the above, the effect that the crosstalk has can be reduced by narrowing the opening width S of each fragmenting portion 9 to 5 μm or smaller.

Third Exemplary Embodiment

Figure 5:
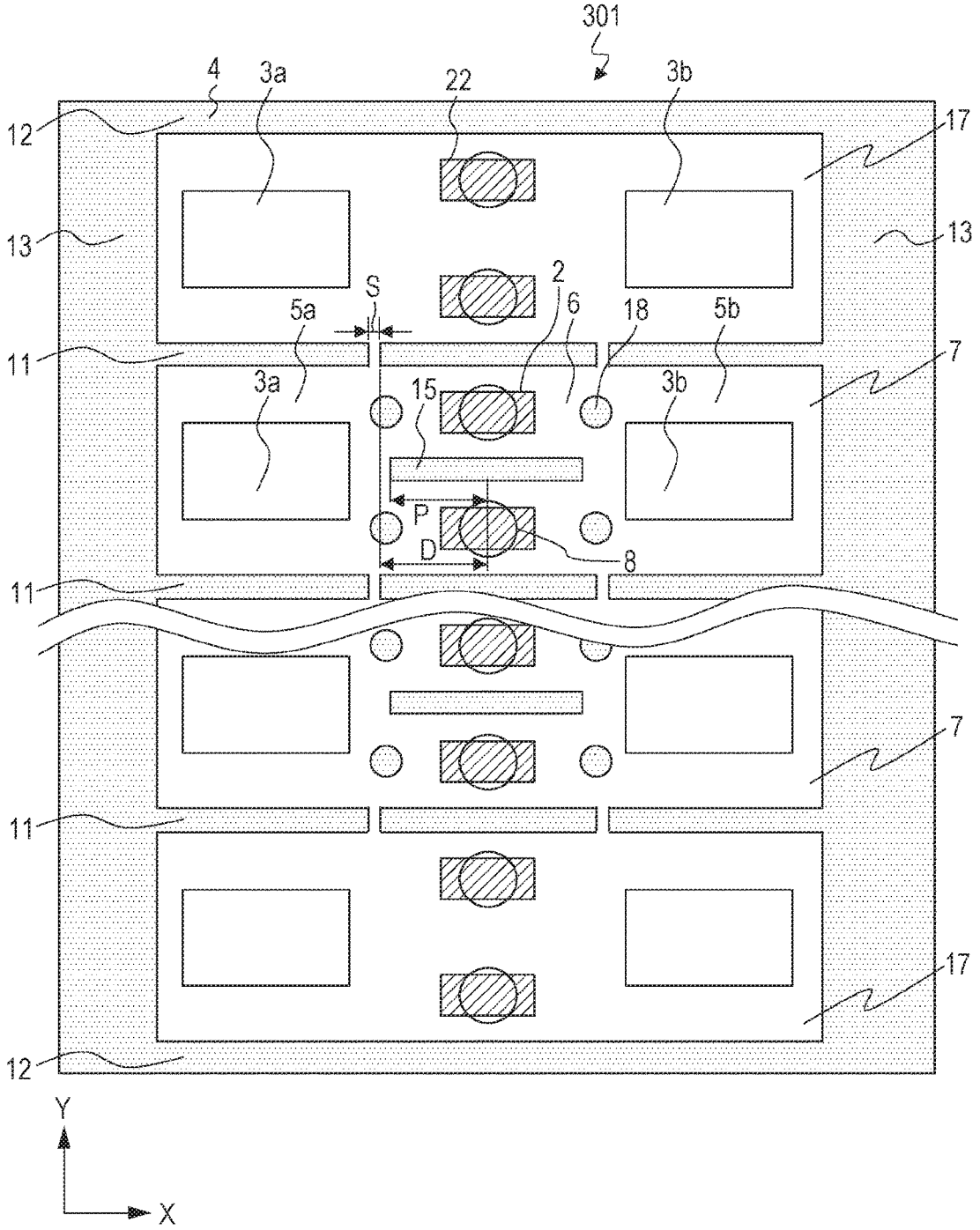
FIG. 5 is a schematic plan view of a liquid ejection head of a third exemplary embodiment of the present disclosure.

FIG. 5 is a plan view illustrating a liquid discharge head 301 of a third exemplary embodiment of the present disclosure in a partial and schematic manner. In the present exemplary embodiment, a single liquid chamber 7 includes a single liquid supply opening 3*a*, a plurality of (two in the exemplary embodiment) energy generating elements 2, and a plurality of (two in the exemplary embodiment) ejection openings 8 that oppose the energy generating elements 2. In the present exemplary embodiment, the ejection openings 8 are arranged at intervals of 600 dpi in the second direction Y, and the liquid supply openings 3*a*, the liquid collect openings 3*b*, and the first side walls 11 are arranged at intervals of 300 dpi in the second direction Y. Filters 18 are disposed between the energy generating elements 2 and the liquid supply openings 3*a*. Compared with the configuration of the first exemplary embodiment, since the opening areas of the liquid supply openings 3*a* are increased and ink is supplied to the plurality of pressure chambers 6, the energy generating elements 2 can be driven at a higher rate.

Figure 6:
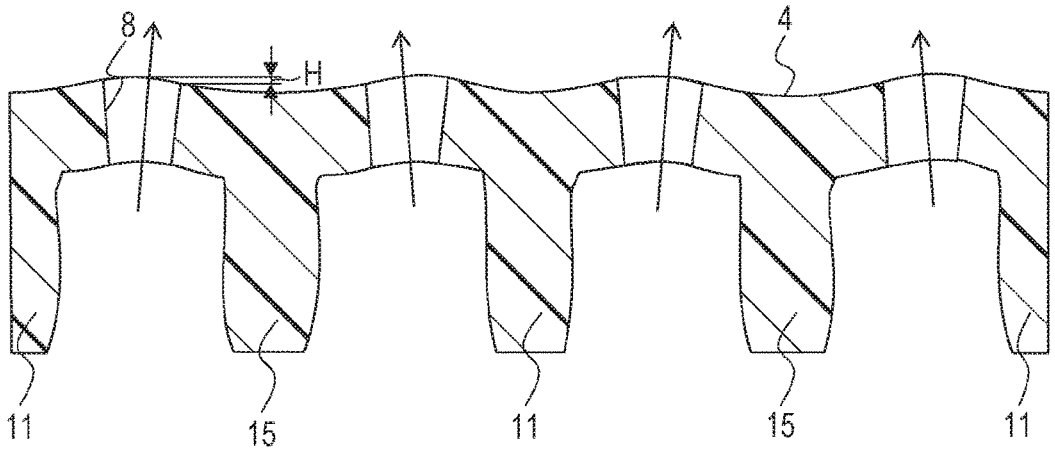
FIG. 6 is a cross-sectional view illustrating a liquid ejection head of a comparative example in a schematic manner.

The plurality of energy generating elements 2 in each liquid chamber 7 is separated from each other by a partition wall 15 that extends in the first direction X. The partition wall 15 is disposed in each of the pressure chamber 6 and is not disposed in the liquid supply openings 3*a* and the liquid collect openings 3*b*. Accordingly, the partition wall 15 is separated from the third side walls 13. The partition walls 15 are formed in a symmetrical manner with respect to a line that passes through the centers of the energy generating elements 2, or the ejection openings 8, and that extends in the second direction Y. In the present exemplary embodiment, since there is a first side wall 11 on one side of each ejection opening 8 and there is a partition wall 15 on the other side of each ejection opening 8, a portion around each ejection opening 8 is more asymmetric compared with the first exemplary embodiment. FIG. 6 illustrates the deformation of the ejection openings 8 in a case in which there is no fragmenting portions 9 in the first side walls 11. The deformation of the first side walls 11 is strongly constrained in the first direction X, and the partition walls 15 are, compared with the first side walls 11, not easily constrained. Accordingly, the ejection openings 8 are deformed so as to be inclined towards the partition walls 15. Since the first side wall 11 and the partition wall 15 are disposed alternately, the directions in which the ejection openings 8 incline are opposite between each of the adjacent election openings 8. As a result, the ejection directions of the ink are opposite in each of the adjacent ejection openings 8, and the print quality is easily reduced. However, by providing the fragmenting portions 9 in the first side walls 21, asymmetry is reduced and the inclination of the ejection openings 8 can be suppressed.

Figure 7:
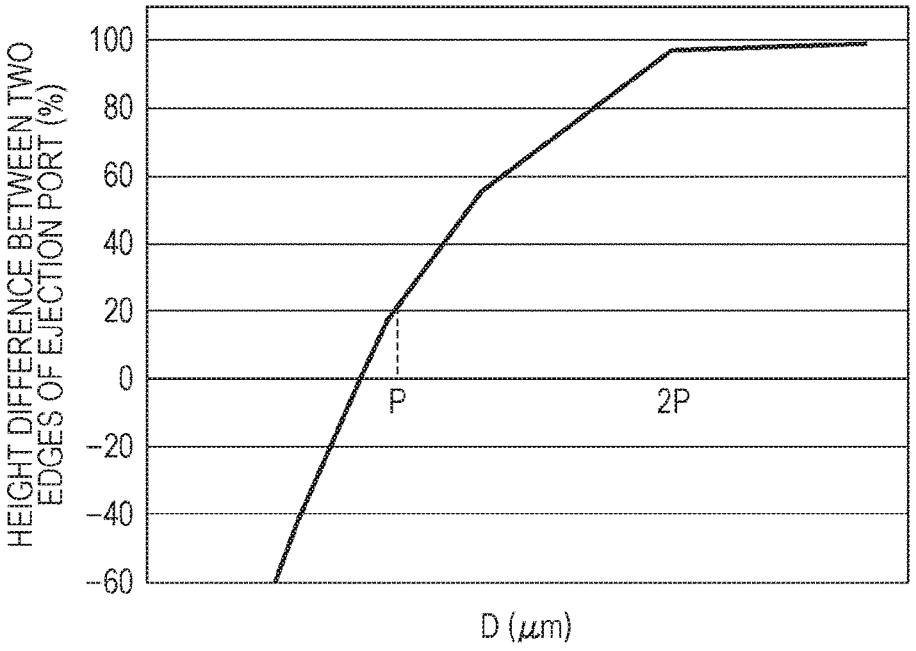
FIG. 7 is a diagram illustrating an example of a relationship between position of fragmenting portion and deformation of ejection opening.

FIG. 7 illustrates the change in the height difference H in the ejection opening 8 when assuming that the distance from the center of the ejection opening 8 to the fragmenting portion 9 in the first direction X is D, and half the value of the length of the partition wall 15 in the first direction X is P [μm]. The opening width S of each fragmenting portion 9 is 2 μm. The height difference H in a configuration in which there is no fragmenting portion 9 is expressed as 100%. The most effective distance D is about D=0.86 P. In a case in which D=P, or in which D=0.72 P, the height difference H can be reduced to about 20%. Accordingly, it is preferable that $0.7\,P \le D \le P$. In a case in which the fragmenting portions 9 are formed near the ejection openings 8, when the opening width S is too wide, the ejection openings 8 become easily affected by the crosstalk with the adjacent ejection openings 8. However, the effect that the crosstalk has can be reduced by setting the opening width S to S<10 μm and, more preferably, to S<5 μm. In a case in which the fragmenting portions 9 overlap the liquid supply openings 3*a* in the first direction X, even if the opening width S is 5 μm or larger, since the crosstalk is absorbed by the liquid supply openings 3*a*, the crosstalk has scarcely no effect. As described above, in the present exemplary embodiment as well, the deformation of the election openings 8 can be suppressed and the effect the crosstalk has can be reduced; accordingly, printing of an image with high quality can be achieved.

In FIG. 5, while the dummy liquid chambers 17 are illustrated, a configuration different from the dummy liquid chambers 17 can be adopted. Specifically, the partition wall 15 is provided between the two dummy elements 22 provided in each of the liquid chambers at the two end portions in FIG. 5. Furthermore, while the element 22 on the end portion side is left as it is as a dummy element 22, the element 22 on the end portion side is not used in recording, and the dummy element on the center side with respect to the dummy element 22 on the end portion side is used in recording as an energy generating element 2. Note that the configurations and the effects that have not been described herein are similar to those of the first exemplary embodiment. The present disclosure can be suitably applied to the liquid ejection heads illustrated in FIGS. 1A and 5 including the liquid supply openings 3*a* that supply a liquid to the pressure chambers 6 that include energy generating elements 2 therein, and the liquid collect openings 3*b* that collects the liquid in the pressure chambers 6. As described above, in a configuration in which the liquid inside the pressure chambers is circulated outside the pressure chambers, since there is a lot of swelling in the ejection opening forming member, the present configuration can be suitably applied.

Fourth Exemplary Embodiment

Figure 8A:
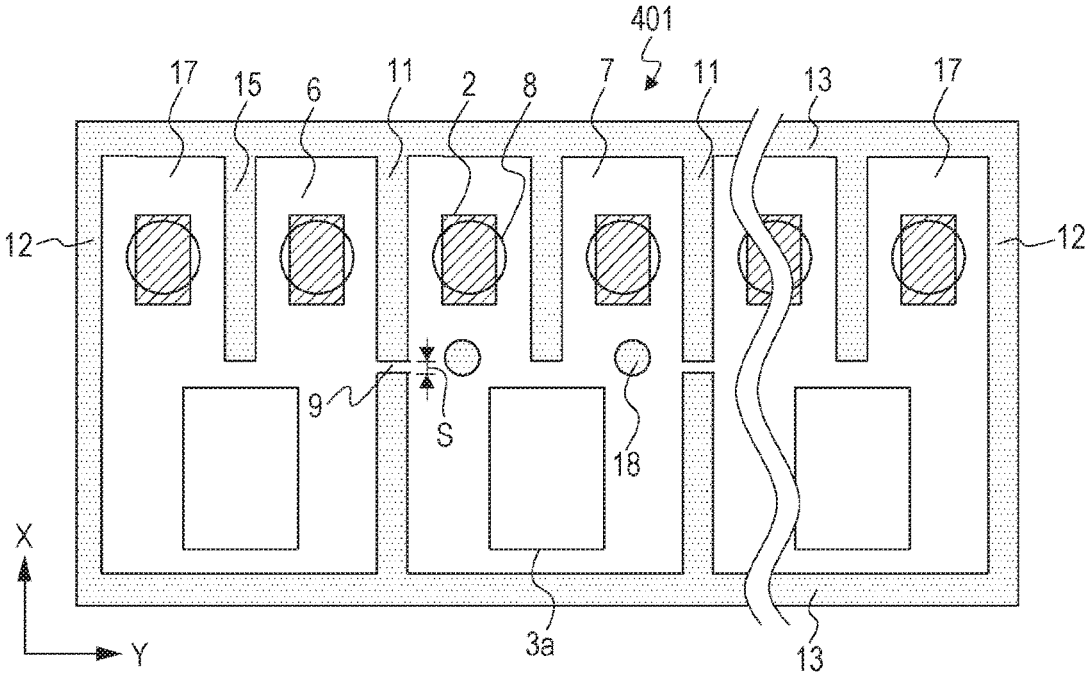
FIGS. 8A and 8B are schematic plan views of a liquid ejection head of the fourth exemplary embodiment of the present disclosure.

FIG. 8A is a plan view illustrating a liquid discharge head 401 of a fourth exemplary embodiment of the present disclosure in a partial and schematic manner. In the fourth exemplary embodiment, the ejection openings 8 are arranged in the width direction of the recording medium. In other words, the second direction. Y corresponds to the width direction of the recording medium. In each liquid chamber 7, the side opposite to the liquid supply opening 3*a* with respect to the energy generating elements 2 is a dead end, and the liquid collect openings 3*b* is omitted. Only a single fragmenting portion 9 is provided in each first side wall 11 in a portion between the corresponding liquid supply opening 3*a* and the corresponding ejection opening 8. In the present exemplary embodiment, a single liquid chamber 7 includes a single liquid supply opening 3*a*, a plurality of (two in the exemplary embodiment) energy generating elements 2, and a plurality of (two in the exemplary embodiment) ejection openings 8 that oppose the energy generating elements 2. The ejection openings 8 are arranged at intervals of 600 dpi in the second direction Y, and the liquid supply openings 3*a* are arranged at intervals of 300 dpi in the second direction Y. The configurations and the effects that have not been described herein are similar to those of the first exemplary embodiment.

In the present exemplary embodiment as well, the deformation of the ejection openings 8, in particular, the inclination of the ejection openings 8 in the second direction Y, due to swelling of the ejection opening forming member 4 can be suppressed with the fragmenting portions 9. The effect of suppressing the deformation of the ejection openings 8 becomes larger as the fragmenting portions 9 are disposed closer to the ejection openings 8, and becomes smaller as the fragmenting portions 9 are disposed farther away from the ejection openings 8. Similar to the first exemplary embodiment, by forming each fragmenting portion 9 so that the opening width S is 10 μm or smaller and, preferably, 5 μm or smaller, while suppressing deformation of the ejection openings 8, the liquid ejection head 401 that can reduce the effect that the crosstalk has on the adjacent ejection opening 8 can be obtained. In the present exemplary embodiment, since the third side walls 13 are in the vicinity of the ejection openings 8, compared with the first exemplary embodiment, it is difficult to suppress the deformation of the ejection openings 8 in the first direction X. However, while it is difficult to correct the ink landing positions in the second direction Y, the ink landing positions in the first direction X can be corrected easily by adjustment of the print conditions and the like.

Figure 8B:
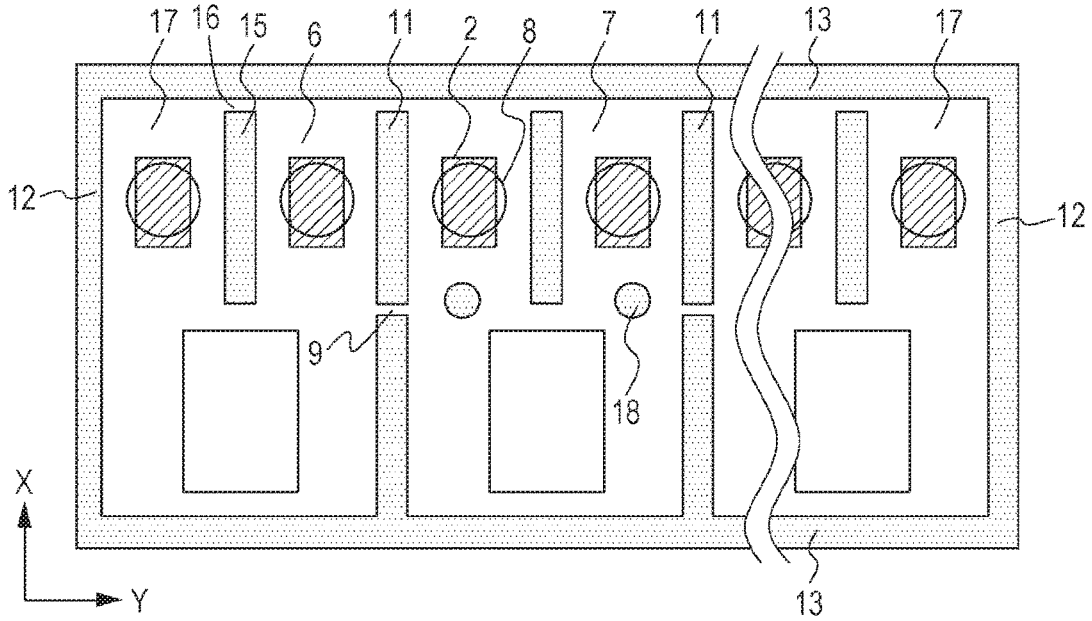

As illustrated in FIG. 8B, the first side walls 11 and the partition walls 15 may be separated from the third side wall 13 that is in the vicinity of the energy generating elements 2. Since the first side walls 11 and the partition walls 15 are separated from the third side walls 13, an effect of suppressing the deformation of the ejection openings 8 in the first direction X can be obtained. Although the effect that the crosstalk has will increase with the above, the effect that the crosstalk has can be reduced by narrowing the opening with of each fragmenting portion 9 to 5 μm or smaller. In FIG. 8B, similar to the third exemplary embodiment, between the two dummy elements 22 inside the liquid chamber 17, the element 22 on the end portion side can be left as it is as a dummy element 22, and the dummy elements 22 on the center side can be changed to an energy generating element 2 and be used in recording.

Figure 9A:
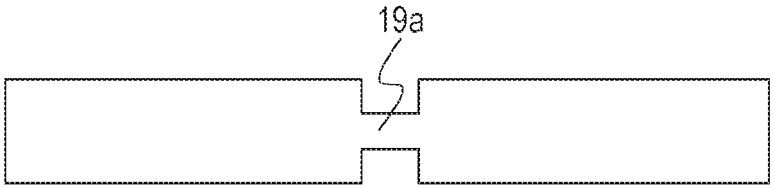
FIGS. 9A to 9C are conceptual diagrams illustrating various shapes of section reducing portions.
Figure 9B:
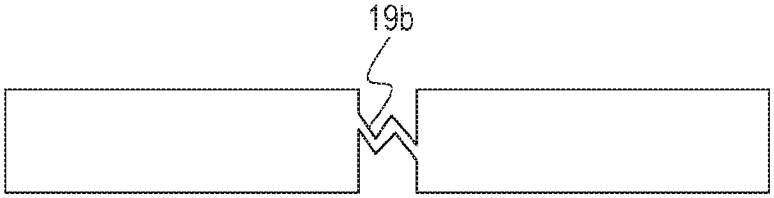
Figure 9C:
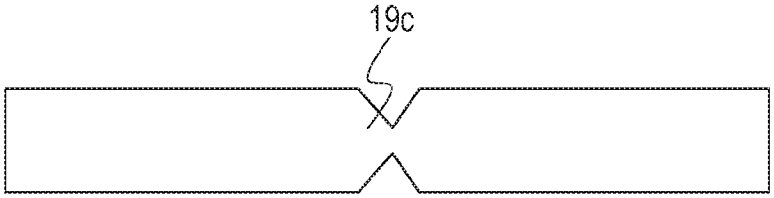

As described above, while some of the exemplary embodiments of the present disclosure have been described, some or all of the fragmenting portions 9 of the present disclosure may be replaced with a section reducing portion that is a portion in which the section vertical to the first direction X has been scaled down. Regarding the section reducing portion, a linear section reducing portion 19*a* illustrated in FIG. 9A, a polygonal line-like shaped section reducing portion 19*b* illustrated in FIG. 9B, or a section reducing portion 9*c* illustrated in FIG. 19C in which the cross-sectional area gradually changes may be employed. Different from the fragmenting portions 9, since the first side walls 11 are formed in a continuous manner and the ink does not flow in from the liquid chambers 7 adjacent to the fragmenting portions 9, the effect that the crosstalk has can be reduced further. Furthermore, since the dummy liquid chambers 17 that prevent the ink from leaking to the outside of the liquid ejection head do not need to be provided, contribution in miniaturing and reducing cost of the liquid ejection head can be made. Although the effect of suppressing the deformation of the ejection openings 8 is small when compared with the fragmenting portions 9, when compared with the first side walls that are not provided with the fragmenting portions 9 or the section reducing portions, an effect of suppressing the deformation of the ejection openings 8 can be obtained.

The present disclosure is capable of providing a liquid ejection head that is capable of suppressing variation in the deformation of the plurality of ejection openings due to swelling.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-101743 filed. May 20, 2016 and No. 2017-044844 filed. Mar. 9, 2017, which are hereby incorporated by reference herein in their entirety.

What is claimed is:

1. A liquid ejection head comprising:

a plurality of liquid chambers each including, an energy generating element that generates energy for ejecting a liquid, an ejection opening that ejects the liquid, and a liquid supply opening that supplies the liquid to the energy generating element, the liquid flowing in a first direction in the plurality of liquid chambers, and the plurality of liquid chambers being arranged in a second direction that intersects the first direction; and a plurality of first side walls that extend in the first direction and that form walls on both sides of the plurality of liquid chambers, wherein each of the plurality of first side walls includes a fragmenting portion that fragments each of the plurality of first side walls in the first direction, or a section reducing portion that is a portion in which a section vertical to the first direction has been scaled down, wherein the plurality of first side walls are shared by adjacent liquid chambers, wherein a continuously extending second side wall that forms a dummy liquid chamber together with a first side wall of the plurality of first side walls is positioned at an end portion in the second direction, and wherein the fragmenting portion or the section reducing portion is provided at a position that is closer to the liquid supply opening with respect to a center of the ejection opening in the first direction.

2. The liquid ejection head according to claim 1, wherein a dummy element that is not driven is provided in the dummy liquid chamber.

3. The liquid ejection head according to claim 1, wherein the fragmenting portion or the section reducing portion provided in each of the plurality of first side walls is provided on a straight line extending in the second direction.

4. The liquid ejection head according to claim 3, wherein each of the plurality of liquid chambers includes, on an opposite side of the liquid supply opening with respect to the energy generating element, a liquid collect opening that collects the liquid or a second liquid supply opening that supply the liquid, and wherein each of the plurality of first side walls includes two of the fragmenting portions or two of the section reducing portion, the two fragmenting portions or the two section reducing portions being provided on both sides of the ejection opening in the first direction at equidistant positions with respect to the ejection opening.

5. The liquid ejection head according to claim 1, further comprising:

a substrate that includes the energy generating element and the liquid supply opening; and an ejection opening forming member that includes the ejection opening and the first side walls.

6. The liquid ejection head according to claim 5, wherein the ejection opening forming member is formed of resin.

7. The liquid ejection head according to claim 1, further comprising:

a liquid collect opening that collects the liquid from the energy generating element.

8. The liquid ejection head according to claim 1, wherein the liquid inside a pressure chamber that has the energy generating element provided therein, is circulated outside the pressure chamber.

* * * * *